US005567187A

United States Patent [19]

Bellinger

[11] Patent Number: 5,567,187

[45] Date of Patent: Oct. 22, 1996

[54] REVERSE INSULATION GRIP BLADE

[75] Inventor: Ray M. Bellinger, Franklin, N.C.

[73] Assignee: Belden Wire & Cable Company, Richmond, Ind.

[21] Appl. No.: 260,766

[22] Filed: Jun. 16, 1994

[51] Int. Cl.[6] ..... H01R 4/10

[52] U.S. Cl. ..... 439/877; 439/866

[58] Field of Search ..... 439/877–881, 439/882, 866; 29/867

[56] References Cited

U.S. PATENT DOCUMENTS

| | | | |
|---|---|---|---|
| 2,814,026 | 11/1957 | Broske | 439/881 |
| 3,495,207 | 2/1970 | Keller et al. | 439/866 |
| 4,840,578 | 6/1989 | Sato | 439/877 |

FOREIGN PATENT DOCUMENTS

| | | | |
|---|---|---|---|
| 638418 | 10/1963 | France | 439/881 |

*Primary Examiner*—David L. Pirlot

*Attorney, Agent, or Firm*—Laff, Whitesel, Conte & Saret, Ltd.

[57] ABSTRACT

A reverse insulation grip blade for an electrical connector includes a contact pin with one of its ends electrically and physically connected to a conductive wire. The wire has strands of conductive material runnning through the core of the wire. The ends of these wire strands are retained by a sheath of insulation at the end of the wire which resists the tendency of the strand ends to fan out from the wire core. The wire is connected to the contact pin by a crimp with crimp arms which overlie the insulation sheath as well as a portion of exposed conductor in the wire.

9 Claims, 4 Drawing Sheets

REVERSE INSULATION GRIP BLADE

This invention relates to electrical connectors, and more particularly to an electrical reverse insulation grip blade.

BACKGROUND

Typical electrical connectors, such as appliance plugs, audio plugs, ring terminals, etc., may include contact pins with wires which have one end connected to the contact pins and another extending away from the contact pin. The wires in such connectors may have a conductive core surrounded by insulation. The conductive core generally includes strands of conductive material, such as copper. The wire strands generally are physically and electrically connected to the contact pin by stripping insulation from the end of the wire to expose the ends of the strands, and crimping these strand ends to the contact pin.

The exposed strand ends, no longer surrounded by insulation, generally "stray" or "fan out" from the longitudinal axis of the wire core. Thus, when electrical connectors are formed in this or similar manner, they often include stray conductive strands which were not captured within the crimp because they have fanned out beyond the dimension of the crimp.

These stray strands can cause the electrical connector to short out and can pose a safety hazard if they extend to the surface of the electrical connector body. Additional disadvantages grow out of the time-consuming and costly inspection system required to assure that any electrical connectors with stray strands which are produced are not put into general circulation. Any connectors found with stray strands are discarded, since removal of stray strands from the electrical connector body is not possible. The generation of such scrap material is a further disadvantage associated with the typical electrical connector. Thus, there is a need for an electrical connector which is substantially stray-strand-proof.

SUMMARY

Accordingly, an object of this invention is to provide a new and improved electrical connector substantially free of stray strands.

Further, it is an object of this invention to provide a reverse insulation grip blade that substantially eliminates or reduces stray wire strands.

Another object is to provide a new and improved method for manufacturing electrical connectors and plugs having a reverse insulation grip blade that substantially eliminates or reduces stray strands in the plugs or connectors.

According to the present invention, the foregoing and other objects and advantages are attained by an electrical connector which includes a contact pin with one of its ends electrically and physically connected to a conductive wire. The wire has strands of conductive material running through the core of the wire. The ends of these wire strands are kept from straying outside the core of the wire by surrounding the end of the wire with a sheath which resists the tendency of the strand ends to fan out from the wire core. In this way, the electrical connector is formed free of stray strands which would otherwise pose safety hazards. The sheath which retains the strand ends is preferably a segment of wire insulation at the end of the wire.

According to another aspect of the invention, the insulated wire is attached to the contact pin at two points. The first attachment is a physical connection between the insulated wire end and the contact pin and the second connection is between the contact pin and a conductive portion of the wire.

In accordance with another aspect of this invention, the contact pin may be a prong or blade used in a commercial electrical plug for insertion into a socket. The wire is crimped to the blade by two pairs of opposing crimp arms folded over portions of the wire. The first pair of crimp arms has sides which converge into points and which are crimped over the retaining sheath so that the inner sides of the crimp arms adjoin each other. The second pair of crimp arms is folded over a portion of wire where the conductor is exposed so that an electrical connection is formed.

In accordance with still another aspect of this invention, one end of the blade is surrounded by an insulating plug body while the other end extends from it so as to be insertable into a jack or socket.

A method of preventing stray wire strands in an electrical connector, according to the present invention, involves placing the end of an insulated wire in a crimp area of a contact pin, blade, or terminal. A first insulated portion of the wire end is crimped to the contact pin, blade or terminal. Insulation is then removed from a second portion of the wire end to expose the conductive wire strands. The second portion is crimped to the contact pin, blade or terminal so as to create an electrical path from the wire to the contact pin, blade or terminal. In accordance with another aspect of the inventive method, the insulation is removed by making a cut in the insulation and separating the insulation at the cut to expose the conductive wire.

Still other objects, advantages and novel aspects of the present invention will become apparent in the detailed description of the invention that follows, in which the preferred embodiment of the invention is shown by way of illustration of the best mode contemplated for carrying out the invention, and by reference to the attached drawings in which.

DESCRIPTION

Figure 1:
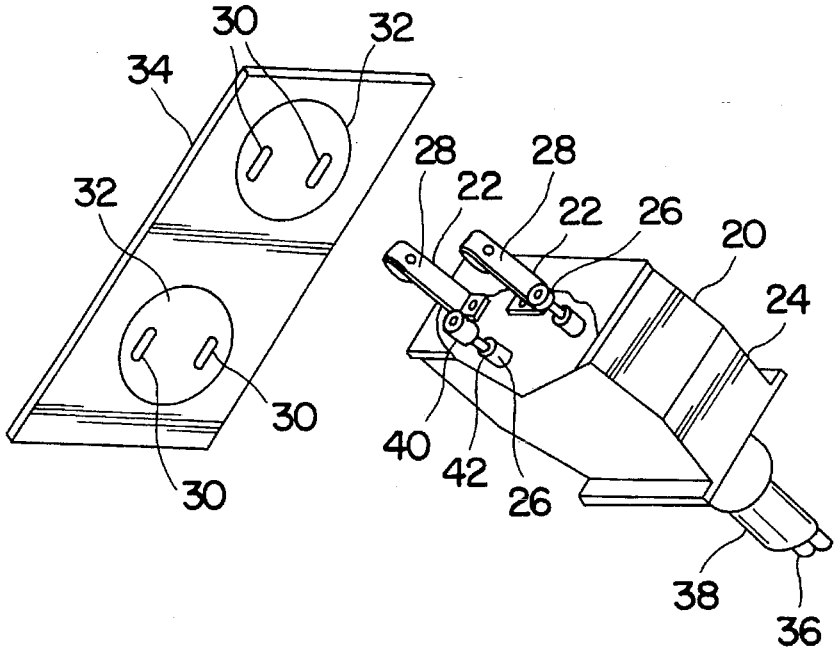
FIG. 1 is a perspective view of an electrical socket and plug incorporating the principles of the invention.

As shown in FIG. 1, an electrical connector, such as plug 20, constructed in accordance with the teachings of this invention has elongated contact pins, such as a pair of blades 22, each having a conducting wire attachment area 26 at one end of the blades 22. The attachment areas 26 are surrounded by a plug body 24 made of insulating material. The blades 22 each have an electrical contact end 28 adapted to be releasably inserted into recessed female electrical contacts 30 of socket 32 of a standard electrical outlet 34, such as those designed to receive NEMA 1-15P or NEMA 5-15P molded plugs.

Each blade 22 has a conventional structure for the male contact end 28. The construction is a folded blade having an aperture near its free end 25 and an upstanding operational flange 25' spaced inwardly from the free end. The flange 25' is used to anchor the blade to the plug 20.

A pair of electrical insulated wires 36 are connected to the blades 22. One insulated wire 36 is connected to each conductive area. The pair of insulated wires 36 may have an insulating cover 38 which extends out from the plug body 24.

Figure 2:
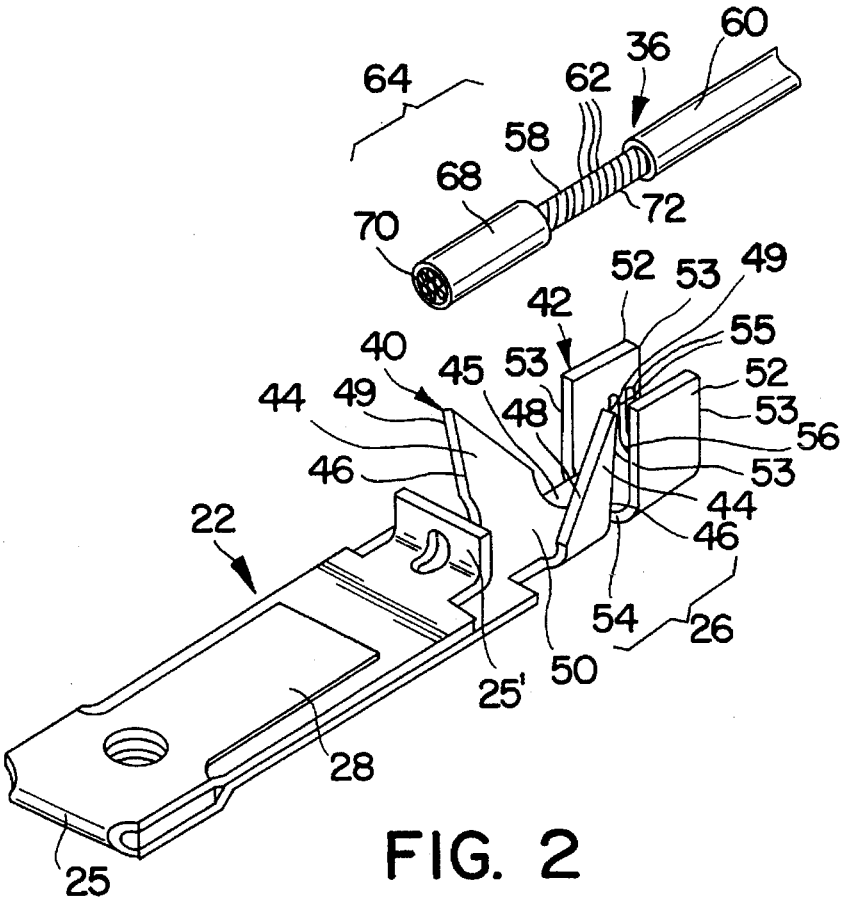
FIG. 2 is an enlarged, exploded, perspective view of the blade and wire of the embodiment of FIG. 1.
Figure 3:
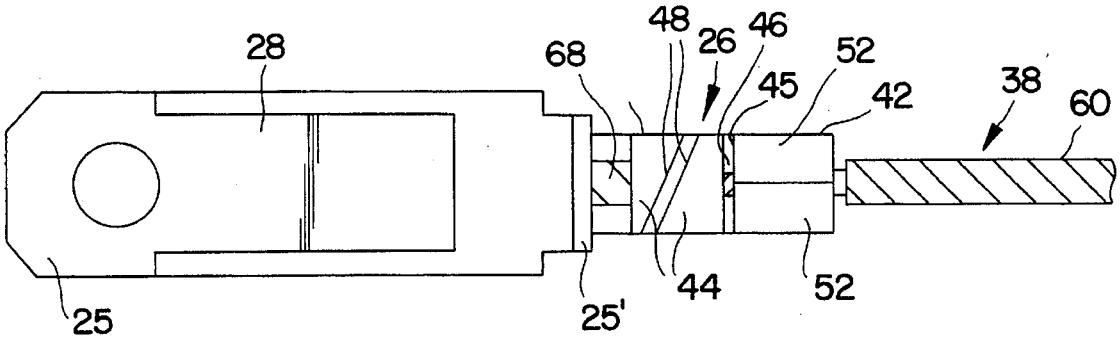
FIG. 3 is a top view of the blade and wire of the embodiment of FIG. 1.
Figure 4:
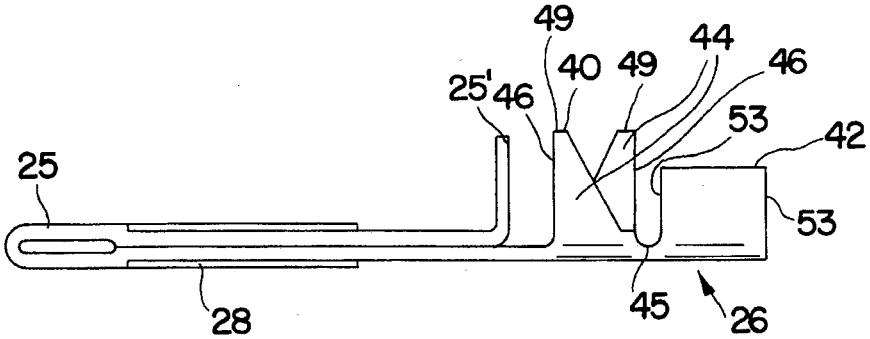
FIG. 4 is a side view of the blade of FIG. 3.
Figure 5:
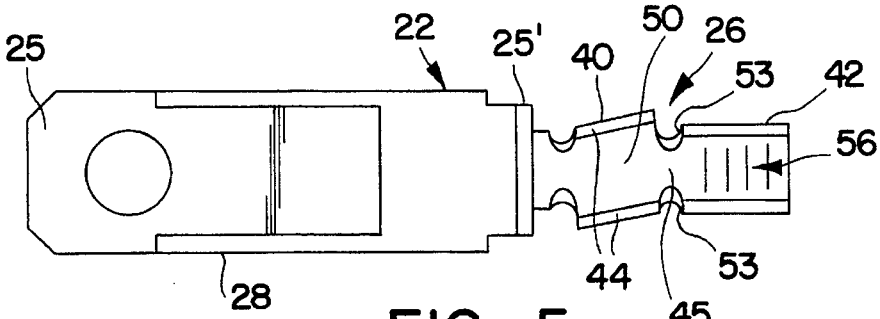
FIG. 5 is a top view of the blade of FIG. 3.
Figure 6:
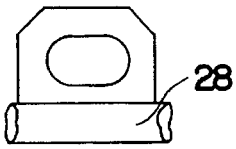
FIG. 6 is an end view of the blade of FIG. 3.
Figure 7:
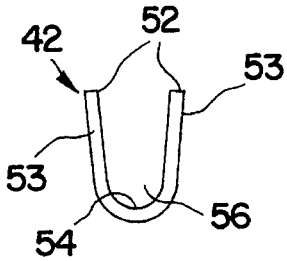
FIG. 7 is another end view of the blade of FIG. 3.

FIGS. 2–7 show in greater detail one of the blades 22 and one of the wires 36 of the electrical plug 20 shown in FIG. 1. The blade 22 is formed by stamping any suitable conductive material, such as metal. The metal is of sufficient thickness to give resiliency to the blade 22 so that the contact end 28 resists deformation during its intended use. In keeping with one aspect of this invention, each blade 22 includes means, here shown as crimps 40, 42, for electrically and physically connecting the wire 36 to the blade 22 at the attachment area 26. The crimps 40 and 42 are shown open in FIG. 2, with the wire 36 exploded away from the blade 22. FIG. 3 shows the crimps closed over the wire 36.

The crimp 40 has opposing crimp arms 44 with outer sides 46 and inner sides 48. The opposing crimp arms 44 extend upwardly from a base 50 (FIG. 2). The crimp 42 has opposing crimp arms 52 extending from a base 54. The crimps 40 and 42 are connected to each other by a flange 45 so that opposing crimp arms 44 are laterally spaced from opposing crimp arms 52. The bases 50, 54 of the crimps 40, 42, and the respective opposing crimp arms 44, 52 form a channel 56. The base 54 and the flange 45 are formed of any suitable conductive material, such as copper, and are electrically connected to the contact end 28 by any suitable means, in this case through the base 50, which is electrically conductive. Preferably, the entire blade 22 is a single stamped piece of metal such as a copper alloy.

Referring to FIGS. 2 and 3, the wire has a conductor or conductive core 58 surrounded by insulation 60. The conductor 58 generally is a plurality of wire strands 62 of a conductive material, i.e. copper, which strands extend through the conductive core and terminate in strand ends 70 at an end region 64 of the wire 36. Means, here shown as a segment 68 of wire insulation 60, are provided for retaining the strand ends 70. The wire insulation segment 68 acts to sheath the end region 64 where the strand ends 70 are located.

Figure 8:
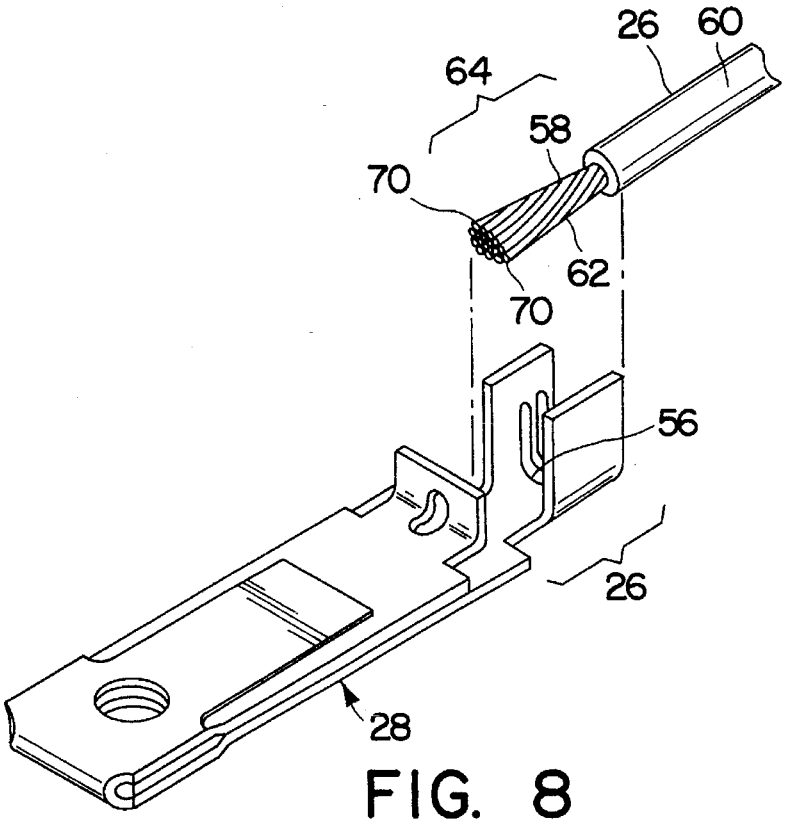
FIG. 8 is an exploded, perspective view of a portion of electrical connector of the prior art.

In conventional electrical connectors, such as that shown in FIG. 8, the strand ends 70 are exposed at the end region 64 of the wire 36. This creates defective electrical connectors with stray strands when the strand ends 70 are not totally captured within the channel 56 of the attachment area 26.

Referring again to FIGS. 2 and 3, according to the present invention, the insulated end 64 of the wire 36 is attached to the blade 22 by the first crimp 40. The crimp 40 has its opposing crimp arms 44 which are generally triangular shaped, folded or crimped toward the base 50 on which the wire 36 lies until the opposing crimp arms 44 overlie the wire insulation segment 68 (FIG. 3). This type of crimp holds the conductors 70 and its insulation in a firm attachment.

The crimp arms 44 include outer sides 46 and inner sides 48 which converge into points 49. The convergence of inner sides 48 is such that when the opposing crimp arms 44 are folded over the wire 36, the inner sides 48 adjoin each other and extend generally parallel to each other (FIG. 3). This configuration of opposing crimp arms 44 with outer and inner sides 46, 48 has the advantage, among others, of two separate fastening arms to retain the end region 64 of the wire 36. Thus, if one of the crimp arms 44 inadvertently fails to overly the wire 36, the wire 36 remains fastened to the blade 22 by means of the other crimp arm 44.

The conductor 58 of the wire 36 is exposed in the region 72 adjacent the end region 64 from which the insulation 60 has been removed. The crimp 42 has crimp arms 52 with sides 53. The crimp arms 52 are folded or crimped over the exposed region 72 toward the base 54 of the attachment area 26 until the opposing crimp arms 52 overlie each other and are in electrical contact with the conductor 58 in the exposed region 72 (FIG. 3). Since the crimp 42 is made of any suitable conductive material, an electrical path is established between the conductor 58, the crimp 42, the flange 54, the crimp 40, and the blade end 28.

Crimp arms 52 can be of any dimension or shape sufficient to hold and form an electrical connection with the exposed region 72 of the wire 36. For example, in this particular embodiment, the crimp arms 52 are of sufficient length to form a "B" crimp against the exposed region 72 (FIG. 3) when folded. The exposed region thus is held against the base by the force of both of the crimp arms 52, thereby creating a stronger electrical contact.

Ridges 55 (FIG. 2) are preferably formed on the internal surface of the crimp arms 52 and the base 54. The ridges extend transversely to the channel 56 along the base 54 and crimp arms 52 and restrain the exposed portion 72 against movement longitudinally within the channel 56.

Figure 9:
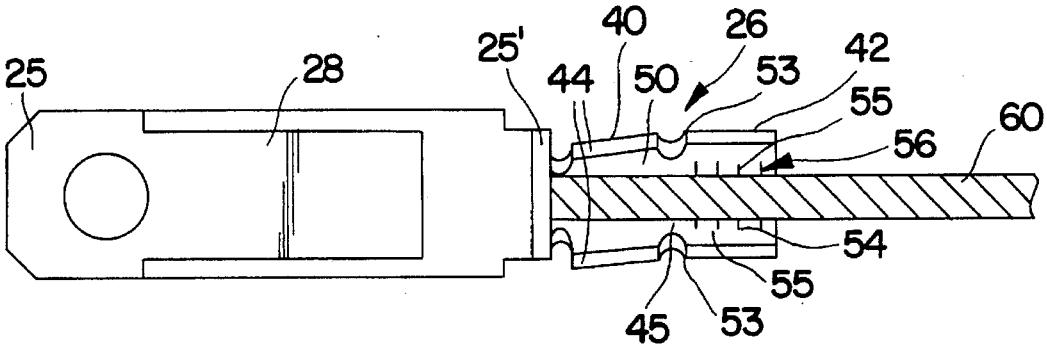
FIGS. 9–12 are top views of an electrical connector formed by a method of the present invention.
Figure 10:
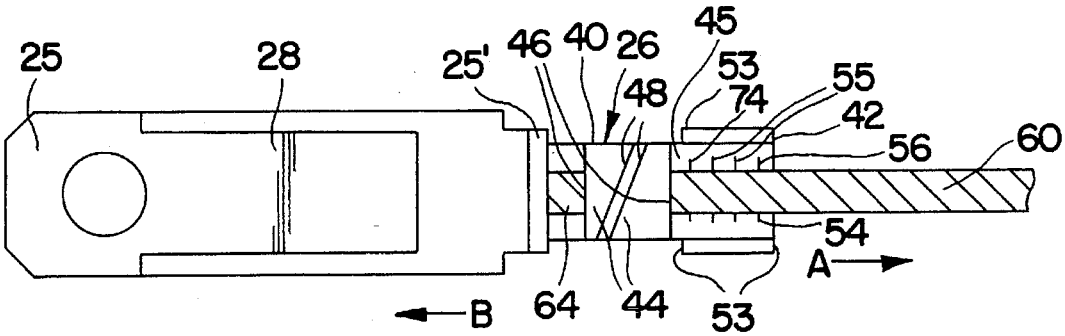
Figure 11:
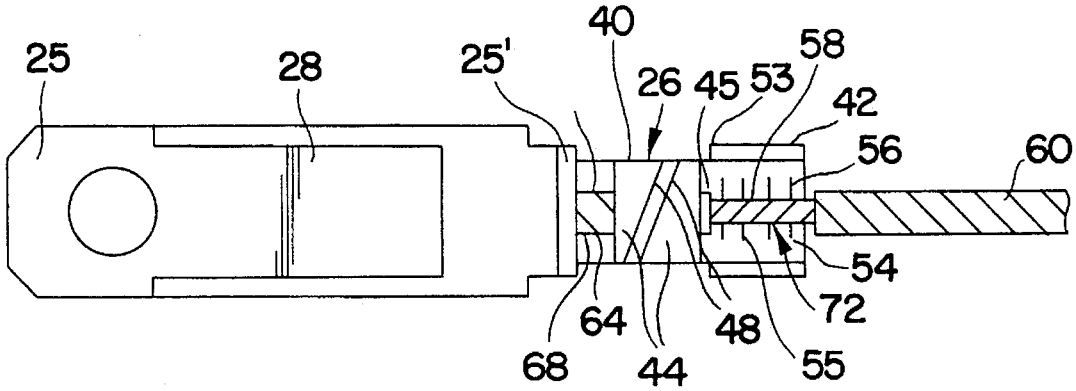
Figure 12:
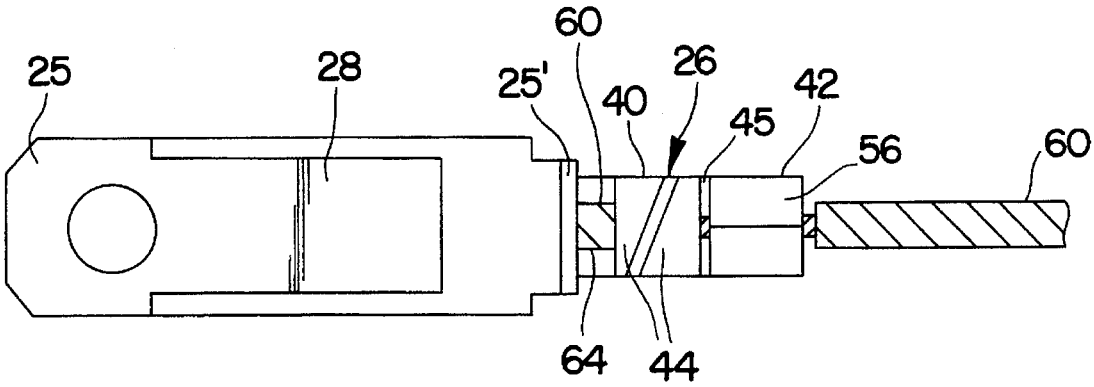

As shown in FIGS. 9–12, one method of making the electrical connector 20 free of stray strands includes the steps of placing an end portion of the wire 36 in the channel 56 of the attachment area 26 (FIG. 9). The end of the wire abuts flange 25', and crimp arms 44 are folded, crimped, or rolled over the end region 64 of the wire 36. The insulation 60 is then removed from a portion of the wire 26 to expose the conductor 58 as seen in FIG. 11. As seen in FIG. 10, the insulation 60 may be removed by making a cut 74 adjacent the end region 64 and proximate to the sides 53 of the crimp arms 52 which are nearer to the end region 64 (FIG. 10). The insulation 60 is separated at the cut 74 by displacing or pulling the insulation 60 in the direction of Arrow A or the blade 22 in the direction of Arrow B, or both, thereby creating the exposed region 72 (FIG. 11), which extends longitudinally in the channel 52 across the base 54 and between the crimp arms 52. The crimp arms 52 are crimped over the exposed region 72 to connect the wire 36 and the blade 22.

Alternative embodiments of the present invention may replace the blade 22 in the connector 20 with any manner of contact pin, terminal, or prong having a contact end for insertion into an aperture and a connecting end for connecting the wire 36 to the electrical connector 20. In still other alternatives, the electrical connector may include one or more prongs, contact pins, terminals, or blades in any appropriate configuration that a particular application may require or that skill or fancy may suggest.

In addition to the advantages apparent from the above description, the method of the present invention has the advantage of combining into one operation the separate processes of stripping and crimping the wire 36. Electrical connectors of the present invention have substantially improved reliability by substantially reducing stray strands during their manufacture.

While the present invention has been described with reference to a preferred embodiment thereof, illustrated in the accompanying drawings, various changes and modifications can be made by those skilled in the art without departing from the spirit and scope of the present invention;

therefore, the appended claims are to be construed to cover equivalent structures.

What is claimed is:

1. An electrical connector comprising:

a) a contact pin having a terminal at one end of the contact pin and a crimp at the other end of the contact pin, the crimp being electrically connected to the terminal, the crimp having a base with opposing sides and two pairs of opposing crimp arms attached to the opposing sides to form a channel in the crimp;

b) a wire having opposing ends, one end being connected to the contact pin by the crimp and the other end extending out from the contact pin, the wire having a conductive core, the conductive core having a cross-section, an exposed region, and conductive strands extending through the conductive core, the conductive strands terminating in a strand end region; and c) a segment of wire insulation surrounding the conductive core at the strand end region, the segment having opposite edges, the first edge substantially at the tip of the wire and the second edge spaced longitudinally along the conductive core from the first edge, the insulation segment having a bore with a cross-section substantially equal to the cross-section of the conductive core to retain the conductive strands from straying outside the conductor core at the strand end region;

the exposed region being located adjacent to the second edge and extending longitudinally therefrom, said first pair of crimp arms being crimped over the insulation segment at the strand end region;

said second pair of crimp arms being crimped over the exposed region to form a conductive path between the conductive core and the contact pin.

2. The connector of claim 1, wherein the conductive core of the wire is substantially surrounded by insulation except for the exposed region proximate to the insulation segment.

3. The connector of claim 1 comprising a connector body of insulating material surrounding the crimp.

4. The connector of claim 1, wherein the opposing crimp arms of said first crimp comprise inner and outer sides which converge to form arm tips, the inner edges of the opposing crimp arms adjoining each other over the insulation segment.

5. The connector of claim 1, wherein one of the pairs of opposing crimp arms is formed into a "B" crimp.

6. A method of preparing an electrical connector, comprising the steps of:

a) providing an electrical contact with an electrical contact end and an electrical wire attachment end;

b) placing an end of an insulated wire on the attachment end of the electrical connector;

c) forming a first crimp over an end portion of the insulated wire;

d) removing insulation from the wire adjacent to said first crimp to form an exposed portion of conductive material in the wire, the exposed portion extending along the wire from the first crimp in a direction away from the end portion of the wire; and e) forming a second crimp over the exposed portion of the wire to create an electrical path between the wire and the electrical connector.

7. The method of claim 6, wherein the electrical connector comprises a plug and the electrical contact comprises a one-piece blade adapted to fit into a standard electric outlet, and further including the steps of providing two of the blades;

repeating steps b) through e) for each of the two blades; and surrounding the electrical wire attachment ends of the electrical contacts with a plug body made of insulating material, thereby forming a standard plug.

8. The method of claim 6, wherein the step of removing insulation includes the steps of:

a) making a single cut in the insulation; and b) pulling the insulation to separate the insulation at the cut to expose conductive material in the wire.

9. The method of claim 8, wherein the step of forming the second crimp comprises forming a "B" crimp against the exposed region.

* * * * *